US005172528A

United States Patent [19]

Clarke

[11] Patent Number: 5,172,528

[45] Date of Patent: Dec. 22, 1992

[54] BUILDING CONSTRUCTION INCORPORATING RECYCLING TIRES

[76] Inventor: Paul H. Clarke, Box 117, Hillsboro Rd., Camden, N.Y. 13316

[21] Appl. No.: 775,454

[22] Filed: Oct. 15, 1991

[51] Int. Cl.[5] ..... E04B 7/00; B41M 3/12; E02D 1/00

[52] U.S. Cl. ..... 52/198; 428/903.3; 52/DIG. 9; 52/169.1

[58] Field of Search ..... 52/198, DIG. 9, 169.1; 404/6; 405/16; 428/903.3

[56] References Cited

U.S. PATENT DOCUMENTS

| | | | |
|---|---|---|---|
| 1,795,655 | 3/1931 | MacDonald | 52/169.1 |
| 2,815,656 | 12/1957 | Klein | 52/169.1 |
| 3,951,384 | 4/1976 | Hildreth | 52/DIG. 9 X |
| 4,057,141 | 11/1977 | Laurie | 428/903.3 X |
| 5,088,253 | 2/1992 | Christ | 52/DIG. 9 X |

*Primary Examiner*—Richard E. Chilcot, Jr.
*Assistant Examiner*—Beth A. Aubrey
*Attorney, Agent, or Firm*—Richard C. Litman

[57] ABSTRACT

A novel building construction including recycled or discarded tires uses compacted bales of such tires as a structural core material. Earth is graded or formed for a foundation in the usual manner, and the compacted bales are arranged either horizontally or vertically and secured together to form cores for floor or wall structures. The tire bale core is then covered with construction screen or reinforcement bar and finally with concrete. When such compacted bales include an axial hollow center, the bales may be concentrically arranged along the axial centers to form air passages for heating and cooling air flow through the floor and/or wall interior. The bales may be stacked to form floors more than one bale layer deep, if desired, and the walls may be constructed more than one bale in thickness in a similar manner. The hollow passages provided by such construction also permits the use of at least some of the hollow vertical passages formed in the walls to be used as forms for the pouring of internal concrete columns to provide structural strength for an overlying roof structure. Remaining hollow passages may be filled with insulating material if desired.

21 Claims, 4 Drawing Sheets

BUILDING CONSTRUCTION INCORPORATING RECYCLING TIRES

FIELD OF THE INVENTION

This invention relates generally to construction for buildings and barriers, and more specifically to a construction system using concrete and incorporating baled or otherwise compacted recycled tires or similar material as a core material for walls, foundations and floors.

BACKGROUND OF THE INVENTION

Disposable articles, trash and related materials are an ever increasing problem in today's world; storage for or disposal of such refuse is increasingly costly. Many such articles, such as used vehicle tires, are exceedingly bulky and are essentially worthless when worn out. In fact, the disposal of used vehicle tires has become so critical that specialized machines and methods have been devised to bundle those used tires for more compact storage or disposal.

In another field, the cost of building construction has increased substantially over time. This has proven especially difficult for the farming industry due to the typically small return for the investment in such farming industry. Meanwhile, capital expenditures are required for the construction of new silos, storage areas and the like. Many such structures require relatively thick and heavy walls due to the nature of the material contained therein, and such walls increase construction cost even further. While in many cases such walls may be filled with earth, the transport of large quantities of earth fill can also prove to be very costly.

The need arises for a system of construction for such buildings which makes use of otherwise discarded materials such as used vehicle tires as an internal component of the wall and/or other structure. The system should provide for most of the benefits of alternate methods of construction, while making use of relatively inexpensive core materials such as used tires. Innovative arrangement of baled bundles of tires may further provide for additional benefits, such as vertical columnar reinforcement by means of poured concrete within the tire bales and air circulation through the wall core due to the air space provided by such bales.

DESCRIPTION OF THE RELATED ART

A. J. Bruner et al. U.S. Pat. Nos. 3,934,540 and 4,186,913 each disclose barriers or revetments formed of a reinforced base of concrete or other material with a plurality of tires bonded therein and partially projecting therefrom. While these patents provide an admirable use of an otherwise wasted item, no disclosure is made of any wall construction making use of such tires, nor does it appear desirable to use more densely baled tires in these constructions.

E. C. Anderson U.S. Pat. No. 4,139,319 and J. E. Taylor U.S. Pat. No. 4,188,153 each disclose revetment construction in which the tires are arranged tangentially (Anderson) or in overlapping rows (Taylor). Essentially the same points applied to the patents of Bruner et al. discussed above also apply here.

D. L. Kiselewski U.S. Pat. No. 4,997,309 and D. L. Greenough U.S. Pat. No. 5,006,014 each disclose a "log" (Kiselewski) or "boom" (Greenough) comprised of a plurality of tires arranged concentrically along their radial axes and filled with a concrete material. These devices may be used as revetments or in the case of the Greenough patent as a flotation device if foam concrete is used. The same limitations of these devices for the purpose of the present invention apply as those discussed above.

R. E Hildeth U.S. Pat. No. 3,951,384 discloses an impact absorbing device comprised of a stack or a plurality of stacks of tires filled with other discarded containers such as cans or plastic bottles. The tires are secured together to form stacks, and the stacks may be secured together by cables. The compression of the tires in order to save space is not disclosed nor does such compaction appear desirable for the purpose of this patent.

R. Comte U.S. Pat. No. 4,406,241 discloses a bumper or fender for use between ships and an adjacent quay or pier. The bumper is composed of a plurality of adjacent tires filled with concrete in a manner similar to some of the above discussed patents. No other relationship is seen to the present invention.

Finally, A. E. Moore U.S. Pat. No. 4,270,329 and M. Lederbauer U.S. Pat. No. 4,785,577 each disclose wall construction using otherwise discarded materials. The Moore patent is directed to an insulated wall using discarded containers and a foam matrix; no use of tires is disclosed. However, the patent to Lederbauer discloses a barrier wall formed of diametrically split tires and a reinforcing frame. The tires are filled with earth and also cut and punctured in order for plant roots to pass therethrough and form a decorative cover. Again, the tires are not compressed for the use disclosed in this patent nor are the modifications to the tires seen as desirable in the present invention.

None of the above noted patents, either singly or in combination, are seen to disclose the specific arrangement of concepts disclosed by the present invention.

SUMMARY OF THE INVENTION

By the present invention, an improved construction for walls and other structures using a filler material is disclosed.

Accordingly, one of the objects of the present invention is to provide an improved construction using otherwise discarded and compacted baled tires as a central fill material.

Another of the objects of the present invention is to provide an improved construction which may make use of any of the standard types of bales of compacted tires which are formed by tire compacting machines.

Still another of the objects of the present invention is to provide an improved construction which may be used in the construction of walls and floors of varying thicknesses and heights.

Yet another of the objects of the present invention is to provide an improved construction which provides for relatively high structural strength.

An additional object of the present invention is to provide an improved construction which may be used for either open or enclosed and roofed structures.

A further object of the present invention is to provide an improved construction which can provide for air circulation by means of internal passages provided by the construction.

Another object of the present invention is to provide an improved construction which may be used for either wall or foundation construction.

Still another object of the present invention is to provide improved methods of construction encompassing the above structures.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
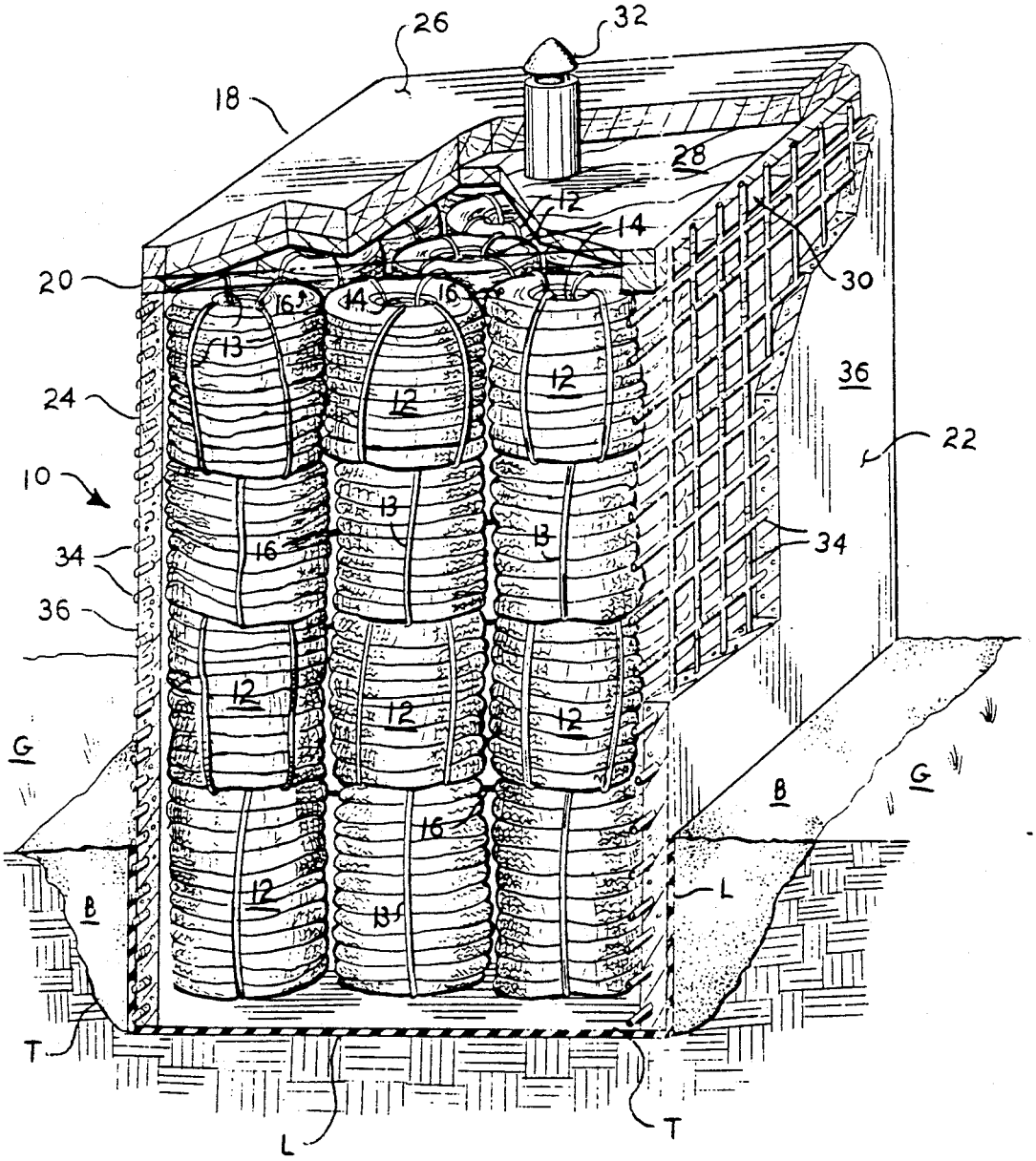
FIG. 1 is a perspective view in section of one embodiment of the wall construction of the present invention.

Referring now to the drawings, particularly FIG. 1 of the drawings, the present invention will be seen to relate to a construction for retaining walls, floors, foundations and the like, which construction makes use of discarded tires which have been compacted and baled as an inner core of the structure. Wall 10 of FIG. 1 will be seen to combine conventional construction techniques and materials with the compressed and baled tire inner core material to form a novel and improved wall construction.

The inner core material is generally comprised of compacted bales 12 of discarded tires, as noted above. Such bales 12 are well known as a method of more compactly storing or disposing of such discarded tires, but heretofore have not been used in combination with a wall construction. Bales 12 are generally formed by stacking a plurality of tires along their concentric radial axes and compressing them under relatively high pressure. In order to prevent the resilience of the tires from expanding the bale after compression, wires 13, cables or the like are passed through the resulting central opening of the bale and tightly secured around the outside of the bale. The resulting bale will be of a generally toroidal cylindrical form with an axial opening or passage which may be used to advantage in the construction of a wall 10 or other embodiment as will be described further below. An alternative form of compressed tire bale may also be used in such wall 10 construction, if desired. Some tire compacting machines will produce essentially cube shaped bales with no central opening or passage. Such cube shaped bales may be used with equal facility in the construction of much of wall 10 or other embodiments. The above description of the formation of a compressed bale of discarded tires is well known in the art, but will serve as background for the use of such bales 12 as a construction material for use with walls 10 and similar structures.

The construction of wall 10 is begun by forming a footing trench T somewhat wider than the planned wall 10 to a depth somewhat below the surrounding ground level G. A liquid impervious liner L is then installed in the trench T, as is well known. At this point, tire bales 12 may be placed in the trench T to form the base of wall 10. The bales 12 will normally be placed or stacked with their concentric open cores 14, if any, oriented vertically. A plurality of bales 12 may be placed one atop another until the desired height of wall 10 is reached, and wall 10 may be constructed to any desired thickness merely by adjusting the number of bales 12 used to span trench T and thereby establish the thickness of wall 10.

Greater stability may be provided for wall 10 during this construction phase by securing adjacent bales 12 together in some manner. Such means as lag screws 16 or the like may be driven through adjacent bales 12 in order to secure them together. Alternatively, bale securing wires 13 may be tied or wired together in order to secure the bales 12 themselves together.

When the desired height of wall 10 is reached, an upper cap 18 may be constructed. Cap 18 is formed of lateral joists 20 extending from the inner side 22 to the outer side 24 of the top 26 of wall 10, with a plywood or other sheet material layer 28 attached thereto. Assuming that some slope is desired to the top 26 of wall 10 to allow for runoff, a longitudinal runner 30 is installed along the inner edge 22 of the top 26 of wall 10 directly to the lateral joists 20, before the installation of sheet material 28. This will provide the desired slope from the inner edge 22 to the outer edge 24 of wall 10 in order to provide for rain water or other runoff from the relatively wide top 26 of wall 10. Passages may be cut through sheet material 28 to provide for the installation of vent pipes 32, which pass through cap 18 into some of the open cores 14 of bales 12. These vent pipes 32 allow for the release of any outgassing or other pressure buildup within wall 10 once it is complete.

Figure 3A:
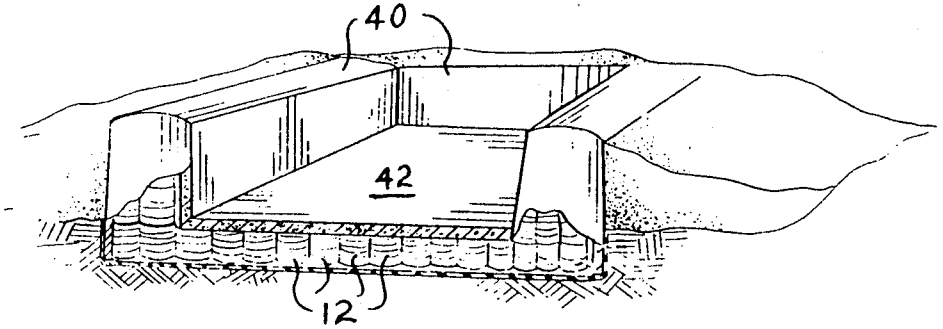
FIG. 3A is a perspective view in section of a typical cellar type construction using the present invention.
Figure 3B:
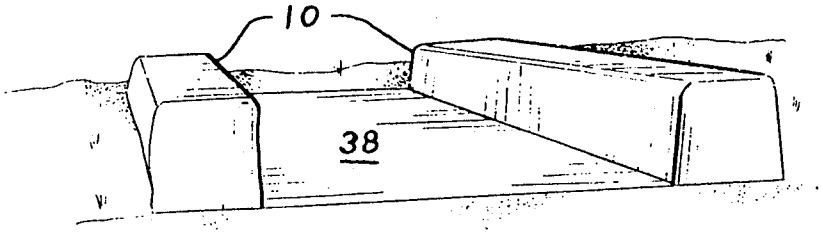
FIG. 3B is a perspective view of an open bunker using the construction disc in the present invention.

At this point, concrete reinforcement means 34 such as construction screen or reinforcement bar (rebar) is installed over the inner and outer surfaces 22 and 24 and cap 18 of wall 10 to serve as reinforcement and support for an outer shell 36 of concrete. The concrete shell 36 may be sprayed or otherwise applied to the inner and outer surfaces 22 and 24 and cap 18 of wall 10, as is known in such construction. Once this concrete shell 36 has cured and any necessary backfill B has been replaced, wall 10 is complete. FIG. 3B shows the completed construction of two such walls 10 to provide an open bunker type storage area. A floor 38 of concrete or other suitable material may be constructed between the two walls 10 in the conventional manner if desired.

Figure 2:
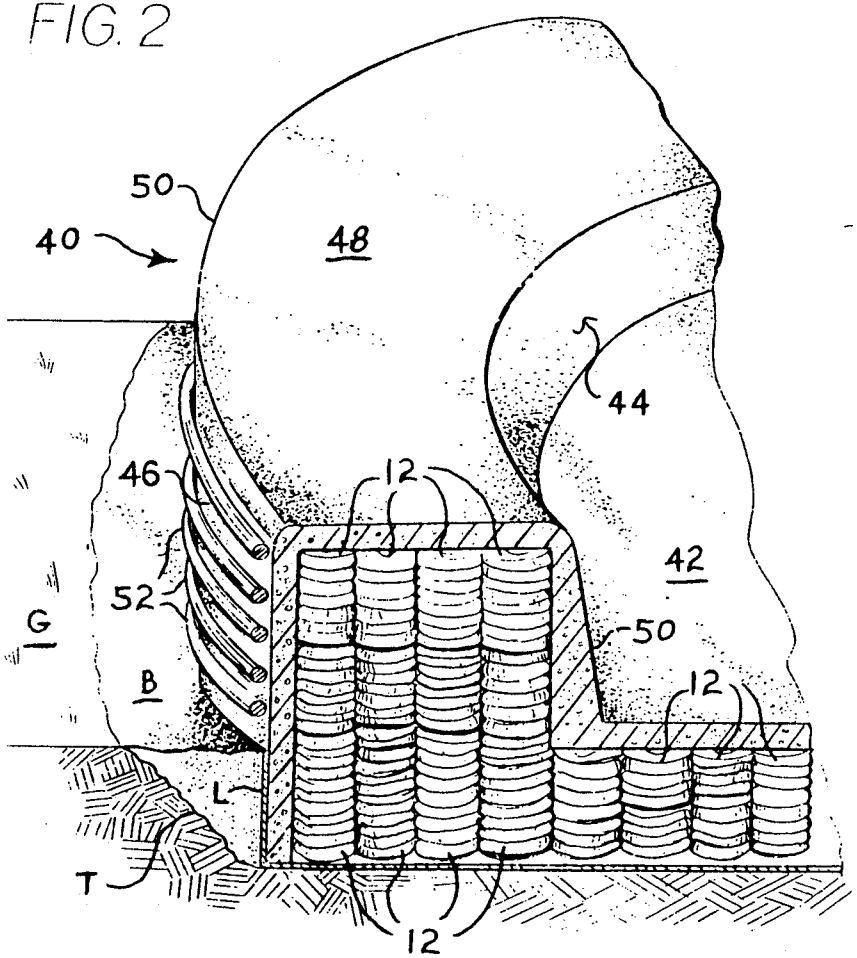
FIG. 2 is an elevation in section of an alternative embodiment incorporating a similar wall and floor construction for a structure.

The above discussion serves to describe the basic construction of a wall 10 utilizing such compressed tire bales 12 as a core material. It will be appreciated that additional variations may be provided which will enhance the strength of such walls or otherwise make them more suitable for certain specialized uses. FIG. 2 shows one such variation. The wall construction disclosed in FIG. 2 is more suitable for use as a swimming pool structure, manure pit, or similar structure which must contain a relatively large volume of liquid or relatively fluid mass. It will be appreciated that such liquids or fluids are capable of building considerable pressure over the bottom surface and along the base of the walls of such a structure. The construction shown in FIG. 2 is intended to handle such pressures. It will be further understood that by their nature, such substances must be entirely surrounded by a circumferential wall 40, or in the case of semi-fluid substances, by a wall 40 which substantially surrounds the containment area. While the construction shown in FIG. 2 discloses only a cross section of such a containment area, it will be understood that such a wall 40 and adjoining bottom 42 may be constructed to substantially or completely enclose a given area.

Such a containment area for fluid substances will require a solid bottom 42 which provides sufficient strength to support the weight of any liquid or other substance contained therein, and which is also impervious to liquids in order to prevent flow either into or out of the contained area. Construction is begun by placing a plastic liner or other liquid impervious barrier L, similar to the liner L used in the construction of wall 10, over the graded or prepared surface where wall 40 and bottom 42 are to be constructed. Tire bales 12, essentially identical to those described in the construction of the wall 10 of FIG. 1, may then be installed over liner L to the desired depth. It may be desirable to build up the bottom 42 of the area contained by wall 42 to a relatively greater height above the finished surface grade by installing tire bales 12 to produce a bottom 42 which is two, or even more, bales thick. In any case, bales 12 may be secured together to prevent shifting by means of lag screws 16 or securing any adjacent baling wires 13, as disclosed in the construction described in FIG. 1, or other suitable means in order to prevent the shifting of tire bales 12.

When this has been accomplished, reinforcement screen or bar 34 may be installed over the inner surface 44, outer surface 46, and upper surface 48 of wall 40 once a cap 18 has been installed as described for the wall 10 of FIG. 1. Such reinforcement 34 will also of course be installed over the bottom 42 of the construction of FIG. 2 at approximately this point in the construction. A concrete shell 50 may then be installed in a conventional manner over the surfaces 44, 46 and 48 of wall 40 and over the bottom 42 contained within any such walls 40.

Other than a bottom 42 construction similar to that disclosed for wall 10, two other primary differences exist for structures intended to contain heavy liquid substances: The concrete shell 50 which lines the inner surface 44 of wall 40 will be seen to be thicker at the edge adjoining bottom 42 than at the edge adjoining upper surface 48, and reinforcing means 52 are provided around the outer circumference of the structure defined by wall 40. Such reinforcing means 52 may comprise cables in tension secured around the outer surface 46 of wall 40, steel rods installed in a similar manner, or other means. The point of these additions to the construction of wall 40 is to provide a corresponding bias toward the inside of the structure in order to counteract any outward pressure by the substance contained within wall 40, as by freezing and resultant expansion of any liquid contained therein, etc. If additional reinforcement is desired, earth fill may be built up along the outer sides 46 of walls 40. FIG. 3A discloses a cellar type bunker structure constructed according to the description for walls 40 and bottom 42 immediately above.

It will be appreciated that the foregoing description of the construction system of the present invention may also be applied to completely enclosed structures with relatively little modification. Two such modifications are desired and/or required for such enclosed, roofed structures: (1) additional support must be provided for the weight of the roof and any additional loads (snow, etc.) which may be encountered, and (2) some form of heating or cooling, and insulating, the internal volume enclosed by the structure is desirable even though not necessarily required.

Figure 4:
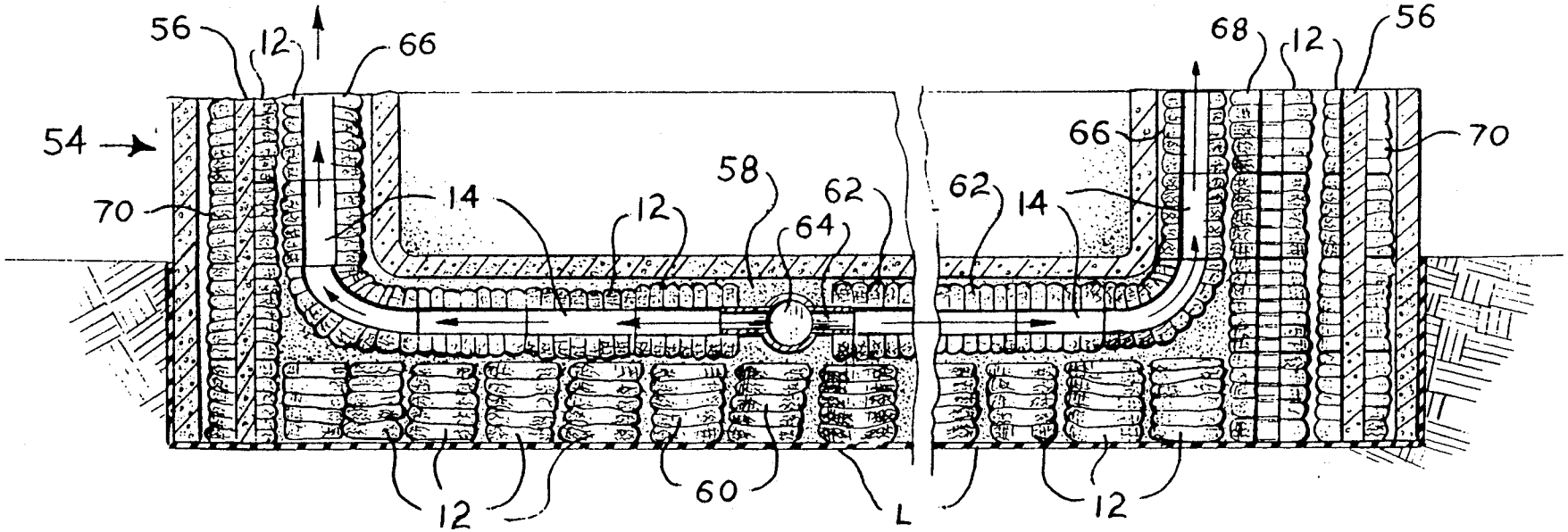
FIG. 4 is an elevation in section of an alternative construction, for air passage throughout the floor and wall structure.
Figure 5:
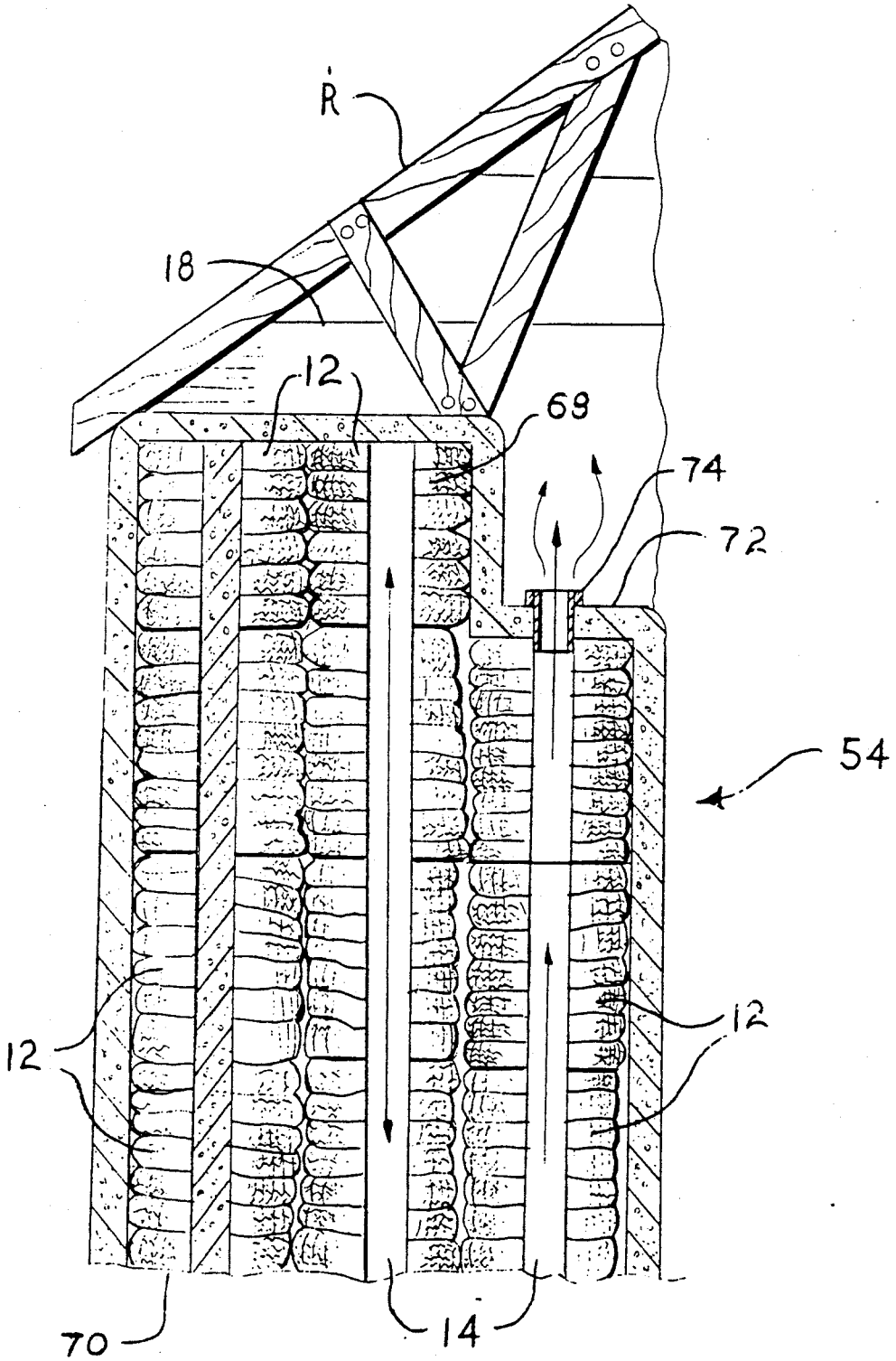
FIG. 5 is an elevation in section of a wall construction providing for air passage in an enclosed structure.

An additional embodiment of the present invention provides for the additional structural support for a roof by merely utilizing the open vertical spaces provided by the cores 14 of stacked bales 12 in a wall structure 54 as shown in FIGS. 4 and 5. At the time such a wall 54 is constructed, the concentric vertical open cores 14 of the tire bales 12 used to form the interior of a wall 54 as shown in FIGS. 4 and 5, may have reinforcement rods inserted and be filled with concrete. This system is highly advantageous in terms of both materials and labor, as no additional forms must be constructed in order to cast the resulting vertical concrete columns 56. The vertical open space resulting from the concentric stacking of bales 12 to form an interior for wall 54 automatically provides a form for the insertion of reinforcing rod and for the pouring of the concrete to form a vertical column 56. The installation of the reinforcing rods and the pouring of the concrete to form such vertical columns 56 may be accomplished shortly before a cap 18 is installed upon such a wall 54, in the manner described above for the wall 10 shown in FIG. 1.

It will be appreciated that it would be most desirable to form such columns 56 in the vertical spaces provided by the outermost stack of tire bales 12, should a wall 54 be constructed of more than a single stack. However, such columns 56 obviously may be formed in any vertical space provided by any stack or stacks of bales 12 in a wall 54 or other similar wall construction, such as that of walls 10 and 40, if desired. Moreover, it may not prove necessary to pour a concrete column 56 in every vertical space provided. Columns 56 may be poured in every second, third or other spacing of the vertical spaces provided by bales 12 in a wall 10, 40 or 54 as required. The only additional requirement for the construction of columns 56 within the walls of the present invention is that the bales 12 used to construct those walls provide sufficient open areas to allow for the formation of such vertical columns 56, and that the bales 12 be oriented within the walls to allow such columns 56 to be poured so as to reach completely to the foundation or underlying surface.

As noted above, it may be desirable to provide heating and cooling to the interior volume enclosed by such a structure as provided by wall 54. The construction disclosed in FIGS. 4 and 5 also provides for this. FIG. 4 discloses the construction of a foundation 58 having integral ductwork allowing for air passage. This construction is initiated much like the construction described above for FIG. 2, in that the surface is prepared and/or graded as required and a liner L is placed thereupon. A first or lower layer 60 of tire bales 12 is then placed over the liner L and filled with sand or earth for support of the overlying materials and floor. A second or upper layer 62 of bales 12 is then installed directly over the first layer 60, the difference being that the central cores 14 of the second layer 62 bales are oriented horizontally and concentrically. The resulting horizontal open passages provide for the movement of heating and/or cooling air which may be applied through those passages to heat or cool the floor above. Additional ductwork 64 may be installed from a furnace or air conditioning unit or the like (not shown) in order to convey the heated or cooled air from the heating or cooling source to the ducts provided by the open passages within upper layer 62 of bales 12. When upper layer 62 and ductwork 64 have been installed, additional sand or earth fill may be installed as with the first layer 60 of bales 12. Screening 34, reinforcement bar or other suitable material may then be placed atop upper layer 62 and a concrete floor poured as described in the construction of FIG. 2 and generally known in the art.

FIG. 4 further discloses bales 12 arranged at the edges of foundation 58 so as to provide a continuation of the air passages provided by the tire bales 12 of the upper layer 62. In this manner, the heated or cooled air provided as described above may be supplied to walls 54 for further temperature control of the interior of such a structure. Preferably, such heated or cooled air is passed through the open cores 14 provided by an inner row 66 of concentrically and vertically stacked bales 12 within wall 54. In this manner, the heated or cooled air passing through such cores 14 of inner row 66 will have the maximum possible effect on the volume within walls 54, and will be affected to the least possible extent by the air temperature outside the structure.

Further insulation of the structure provided by the present invention may be achieved by providing a center row 68 of bales 12 which remain empty, that is no additional material is included within the open cores 14 provided by such bales 12. Alternatively, such central bales 14 might be filled with insulating material in order to further isolate the interior of the structure from the outside environment. It is anticipated that by providing three rows of bales 12 (inner 66, center 68, and outer 70), that the outermost row 70 may be used for the containment of concrete columns 56 for the support of a roof structure R. Alternatively, the center row 68 of bales 12 within wall 54 may be deleted in order to form a more compact structure, leaving only an inner row 66 providing for air passage as discussed above, and an outer row providing for greater structural strength by means of concrete columns 56 poured therein. Conceivably, only a single outer row 70 might be used for some light structures, with alternating cores 14 used for concrete columns 56 and the remaining cores 14 used for air passage. Obviously, many variations of the above arrangements are possible within the scope of the present invention.

Assuming that wall 54 has been constructed as shown in FIG. 5, with an innermost row 66 of bales 12 providing passages for ventilation or air circulation, it may be desirable to provide a shelf 72 adjacent roof truss R in order to provide an outlet or return 74 for the air passages provided within the inner row 66 of bales 12 in wall 54. Should any ceiling structure be installed beneath roof truss R, such a relief or shelf 72 would prove essential as the alternative would be to cut into the side of a bale 12 adjacent roof truss R in the inner row 66 in order to allow any air contained within cores 14 to exit.

When bales 12 have been arranged in the manner desired as described above in order to form the interior portions of walls 54, reinforcement screen or bar 34 may be used to cover the interior and exterior surfaces of wall 54 and a concrete shell applied thereto, as described in the construction of walls 10 and 40. The construction described above and shown in FIGS. 4 and 5 may provide for enclosed structures such as warehouses, garages, barns and other storage areas in which protection from the elements is desired. It is conceivable that such closed structures might also be used for more sophisticated buildings or housing; the structures disclosed herein are adaptable to a multitude of uses limited only by the imagination of the builder.

It is to be understood that the present invention is not limited to the embodiments described above, but encompasses any and all embodiments within the scope of the following claims.

I claim:

1. A structure including compacted tires secured in bales, said structure comprising;

a plurality of said bales arranged horizontally in one or more rows immediately adjacent one another and secured to one another to form a structural core, said structural core covered with concrete reinforcement means, and said structural core and concrete reinforcement means covered with a concrete shell.

2. The structure of claim 1 wherein;

said bales are arranged in one or more horizontal layers and covered with concrete reinforcement means and concrete to form a floor.

3. The structure of claim 1 wherein;

said bales are arranged in two or more linear rows stacked vertically and covered with concrete reinforcement means and concrete to form a wall.

4. The structure of claim 3 wherein;

said wall includes a top having a cap and vent means extending through said cap.

5. The structure of claim 3 wherein;

said bales are arranged in two or more adjacent linear rows with one or more corresponding rows stacked thereupon.

6. A structure including compacted tires secured in bales, each said bales including a hollow axial core, said structure comprising;

a plurality of said bales arranged horizontally in one or more rows immediately adjacent one another with said hollow axial cores coaxially aligned and concentric with one another to form one or more elongated hollow passages, Said bales secured to one another to form a structural core, said structural core covered with concrete reinforcement means, said structural core and concrete reinforcement means covered with a concrete shell, whereby said elongated hollow passages provide for the flow of heated or cooled air therethrough.

7. The structure of claim 6 wherein;

said bales are arranged horizontally in one or more rows immediately adjacent one another with said hollow axial cores horizontally and coaxially aligned and concentric with one another to form one or more horizontal elongated hollow passages and covered with concrete reinforcement means and concrete to form a floor, whereby said horizontal elongated hollow passages provide for the flow of heated or cooled air within said floor.

8. The structure of claim 6 wherein;

said bales are arranged in one or more linear rows stacked vertically with said hollow axial cores arranged concentrically to form vertical elongated hollow passages and covered with concrete reinforcement means and concrete to form a wall, whereby said vertical elongated hollow passages provide for the flow of heated or cooled air within said wall.

9. The structure of claim 8 wherein;

one or more of said vertical elongated hollow passages is filled with concrete reinforcement means and concrete to form roof support means for said structure.

10. A method of constructing a structure, said structure including compacted tires secured in bales, the method comprising;

forming an earth foundation for said structure, providing a liner within said foundation, installing said tire bales upon said liner and securing said bales together, installing concrete reinforcement means over said tire bales, and covering said tire bales and concrete reinforcement means with concrete.

11. The method of claim 10 wherein;

said bales each include a hollow axial core.

12. The method of claim 11 including;

installing said bales horizontally in one or more rows immediately adjacent one another with said hollow axial cores coaxially aligned and concentric with one another to form one or more elongated hollow passages.

13. The method of claim 12 including;

installing said bales horizontally in one or more rows immediately adjacent one another with said hollow axial cores horizontally and coaxially aligned and concentric with one another and thereby forming one or more horizontal elongated hollow passages, and concrete to form a floor.

14. The method of claim 12 including;

arranging said bales in two or more linear rows stacked vertically with said hollow axial cores arranged concentrically to form vertical elongated hollow passages, and covering said bales with concrete reinforcement means and concrete to form a wall.

15. The method of claim 14 including;

filling one or more of said vertical elongated hollow passages with concrete reinforcement means and concrete to form roof support means for said structure.

16. The method of claim 15 including;

constructing a roof upon said structure.

17. A method of constructing a structure, said structure including compacted tires secured in bales with said bales each including a hollow axial core, the method comprising;

forming an earth foundation for said structure, providing a liner within said foundation, installing said tire bales horizontally in one or more rows immediately adjacent one another upon said liner with each said hollow axial core coaxially aligned and concentric with one another to form one or more elongated hollow passages, securing said bales together, installing concrete reinforcement means over said tire bales, and covering said tire bales and concrete reinforcement means with concrete.

18. The method of claim 17 including;

installing said bales horizontally in one or more rows immediately adjacent one another with said hollow axial cores horizontally and coaxially aligned and concentric with one another and thereby forming one or more horizontal elongated hollow passages, and covering said bales with concrete reinforcement means and concrete to form a floor,

19. The method of claim 17 including;

arranging said bales in two or more linear rows stacked vertically with said hollow axial cores arranged concentrically to form vertical elongated hollow passages, and covering said bales with concrete reinforcement means and concrete to form a wall.

20. The method of claim 19 including;

filling one or more of said vertical elongated hollow passages with concrete reinforcement means and concrete to form roof support means for said structure.

21. The method of claim 20 including;

constructing a roof upon said structure.

* * * * *